US009657499B2

(12) United States Patent
Emory

(10) Patent No.: US 9,657,499 B2
(45) Date of Patent: May 23, 2017

(54) METHOD AND APPARATUS FOR A REKEYABLE MASTER KEY LOCK

(75) Inventor: Mark W. Emory, Placentia, CA (US)

(73) Assignee: Spectrum Brands, Inc., Madison, WI (US)

( * ) Notice: Subject to any disclaimer, the term of this patent is extended or adjusted under 35 U.S.C. 154(b) by 986 days.

(21) Appl. No.: 13/465,276

(22) Filed: May 7, 2012

(65) Prior Publication Data

US 2013/0086958 A1 Apr. 11, 2013

Related U.S. Application Data

(60) Provisional application No. 61/545,241, filed on Oct. 10, 2011.

(51) Int. Cl.

| | |
|---|---|
| ***E05B 27/04*** | (2006.01) |
| ***E05B 29/06*** | (2006.01) |
| ***E05B 29/00*** | (2006.01) |
| ***E05B 27/00*** | (2006.01) |

(52) U.S. Cl.

CPC ..... *E05B 29/004* (2013.01); *E05B 27/005* (2013.01); *E05B 29/0046* (2013.01); *E05B 29/0066* (2013.01); *E05B 29/0033* (2013.01); *E05B 29/0073* (2013.01); *Y10T 29/49* (2015.01); *Y10T 70/7559* (2015.04); *Y10T 70/7599* (2015.04); *Y10T 70/7616* (2015.04)

(58) Field of Classification Search

CPC .. E05B 29/0066; E05B 29/0046; E05B 29/00; E05B 29/0013; E05B 29/004; E05B 29/0033; E05B 29/0073; E05B 29/08; E05B 27/005; E05B 27/0082; Y10T 29/49; Y10T 70/7599; Y10T 70/7616; Y10T 70/7559

USPC .. 70/337–343, 382–385, 368, 492, 493, 495

See application file for complete search history.

(56) References Cited

U.S. PATENT DOCUMENTS

| | | | | |
|---|---|---|---|---|
| 3,595,043 A | | 7/1971 | Williams | |
| 4,069,694 A | * | 1/1978 | Raymond et al. | 70/337 |
| 4,372,139 A | | 2/1983 | Laake | |
| 4,429,555 A | * | 2/1984 | Salsbury | 70/366 |
| 4,616,492 A | * | 10/1986 | Barfield | 70/284 |

(Continued)

FOREIGN PATENT DOCUMENTS

| | | |
|---|---|---|
| CA | 2661241 | 4/2009 |
| TW | 201009174 | 1/2006 |

OTHER PUBLICATIONS

USPTO; International Search Report; PCT/US2012/059312; Jan. 9, 2013.

*Primary Examiner* — Lloyd Gall
(74) *Attorney, Agent, or Firm* — Barnes & Thornburg LLP

(57) ABSTRACT

A rekeyable master lock includes a plurality of pin gears, with each pin gear engaged with a corresponding key follower. As each key follower rides up and down on the key bitting, it causes a corresponding pin gear to rotate. Each pin gear engages a user gear and a master gear so that, as the pin gear rotates, the user and master gears rotate. Each user and master gear, in turn, drives a corresponding user rack and a master rack. When a valid user key is inserted and rotated, the user racks or master racks are aligned along a common axis and held in alignment by a locking bar. Longitudinal movement of the user gear or master gear allows the rekeying function by decoupling and recoupling the user gear or master gear with the user racks or master racks.

21 Claims, 14 Drawing Sheets

(56) References Cited

U.S. PATENT DOCUMENTS

| | | | | |
|---|---|---|---|---|
| 4,712,402 | A | 12/1987 | Monahan | |
| 4,942,749 | A * | 7/1990 | Rabinow | 70/495 |
| 6,119,495 | A * | 9/2000 | Loreti | 70/340 |
| 6,862,909 | B2 * | 3/2005 | Armstrong et al. | 70/492 |
| 7,007,528 | B2 * | 3/2006 | Chong et al. | 70/492 |
| 7,900,491 | B2 * | 3/2011 | Chong | 70/492 |
| 8,490,446 | B2 * | 7/2013 | Rao et al. | 70/383 |
| 2003/0084692 | A1 * | 5/2003 | Herdman | 70/338 |
| 2003/0154753 | A1 * | 8/2003 | Dimig et al. | 70/495 |
| 2005/0016234 | A1 * | 1/2005 | Strader et al. | 70/492 |
| 2006/0117822 | A1 * | 6/2006 | Boesel et al. | 70/495 |
| 2007/0101782 | A1 * | 5/2007 | Shen | 70/495 |
| 2008/0078224 | A1 | 4/2008 | Wheatland et al. | |
| 2008/0236224 | A1 * | 10/2008 | Chong | 70/358 |
| 2008/0264127 | A1 * | 10/2008 | Chiang et al. | 70/492 |
| 2009/0007615 | A1 * | 1/2009 | Chiang et al. | 70/491 |
| 2009/0031774 | A1 | 2/2009 | Armstrong et al. | |
| 2010/0037666 | A1 * | 2/2010 | Chong | 70/490 |
| 2010/0050717 | A1 * | 3/2010 | Chiang et al. | 70/377 |
| 2010/0206025 | A1 * | 8/2010 | Boesel et al. | 70/340 |
| 2011/0011139 | A1 * | 1/2011 | Marcelle et al. | 70/372 |
| 2011/0226027 | A1 * | 9/2011 | Huang et al. | 70/493 |

* cited by examiner

METHOD AND APPARATUS FOR A REKEYABLE MASTER KEY LOCK

RELATED APPLICATION

This application claims priority to U.S. Provisional Patent Application Ser. No. 61/545,241, filed Oct. 10, 2011, titled "Master Keyable Rekeyable Smart Key".

FIELD OF THE INVENTION

The present invention relates to mechanical keyed lock cylinders and particularly to lock cylinders that can be master keyed. More particularly, it relates to mechanical keyed lock cylinders capable of having user keys and master keys rekeyed without disassembly of the lock cylinder.

BACKGROUND OF THE INVENTION

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

The present invention overcomes these and other disadvantages of conventional lock cylinders. The lock cylinder of the present invention operates in a transparent way that presents the familiar experience of inserting a key and rotating the key in the lock cylinder, as with current cylinders. However, in the present invention, that same familiar experience is used to rekey the lock cylinder. Thus, the user does not require any special knowledge, training, or tools to rekey the lock cylinder of the present invention.

Managers of multi-unit complexes such as, for example, apartment buildings or hotels, find the use of rekeyable locks to be particularly advantageous. In the past, when a user's lease expired, the manager or landlord had to change the locks to protect the security of the subsequent tenant by preventing the previous user from reentering the property. Rekeyable locks allow the manager to rekey the lock, thereby rendering the previous user's key obsolete, without removing the lock, saving time and money.

Managers also need to have access to their property when the current user is not available or when the user's key is lost or stolen. Rather than carry a duplicate key for each unit, which could become very cumbersome in large complexes, managers employ master keying systems that use special locks capable of being operated by two different keys. Such master keying systems allow each user to have a unique key while, at the same time, allowing the manager to operate all of the locks in a complex with one, or at most a few, master keys.

Unfortunately, as with conventional locks, master keying system locks typically require the manager to remove the cylinder mechanism from the lockset and then disassemble the cylinder to some degree to remove the plug and replace the pins. Access to master key system locks that can be quickly and easily rekeyed would be very advantageous to property managers. Even greater advantage would be derived from a master key system that allows both the user key and master key to be rekeyed.

Smith, in U.S. Pat. No. 4,741,188, discloses a rekeyable master keying system with a pin and tumbler design that uses master shims or wafers positioned in between the pins of the lock cylinder to establish a shear line for the master key and user keys. In Smith's cylinder, each rekeying operation involves completely removing one of the wafers from the lock cylinder. Unfortunately, that means that only a limited number of rekeying operations are available. Once a particular key bitting has been used, it cannot be reused without disassembling the lock cylinder to reinstall the missing wafer(s) necessary for that particular bitting. Moreover, the user keys and master keys require different notches to be cut in the spine of the key to accommodate the wafers at different pin positions, which adds complexity.

The present invention overcomes these disadvantages and others by providing a mechanical keyed lock cylinder capable of rekeying the user and master keys without completely eliminating previously used key combinations, thereby providing increased usability. In addition, the user key and master key utilize separate internal parts, thereby providing increased security.

SUMMARY OF THE INVENTION

A preferred embodiment of the present invention includes a method of rekeying a master keyable lock that comprises the steps of providing a plug assembly rotatable within a housing, providing a plurality of key followers disposed in the plug assembly; providing a plurality of user racks and a plurality of master racks disposed in the plug assembly, with each of the plurality of user racks and plurality of master racks being coupled to an associated key follower and movable in response to movement of the associated key follower, inserting a first key with a first key bitting, aligning one of the plurality of user racks and plurality of master racks to a common axis, decoupling the one of the plurality of user racks and plurality of master racks from the plurality of key followers, removing the first key and inserting a second key with a second key bitting, and recoupling the one of the plurality of user racks and plurality of master racks to the plurality of key followers.

A preferred embodiment of the present invention provides a master keyable rekeyable lock having a longitudinal axis, a housing, a plug assembly disposed for rotation within the cylinder housing, a plurality of key followers disposed in the plug assembly, a first plurality of racks disposed in the plug assembly and coupled to the plurality key followers, a second plurality of racks disposed in the plug assembly and coupled to the plurality key followers, and a locking bar disposed in the housing for selectively engaging one of the first plurality of racks and the second plurality of racks.

DETAILED DESCRIPTION OF THE DRAWINGS

Figure 1:
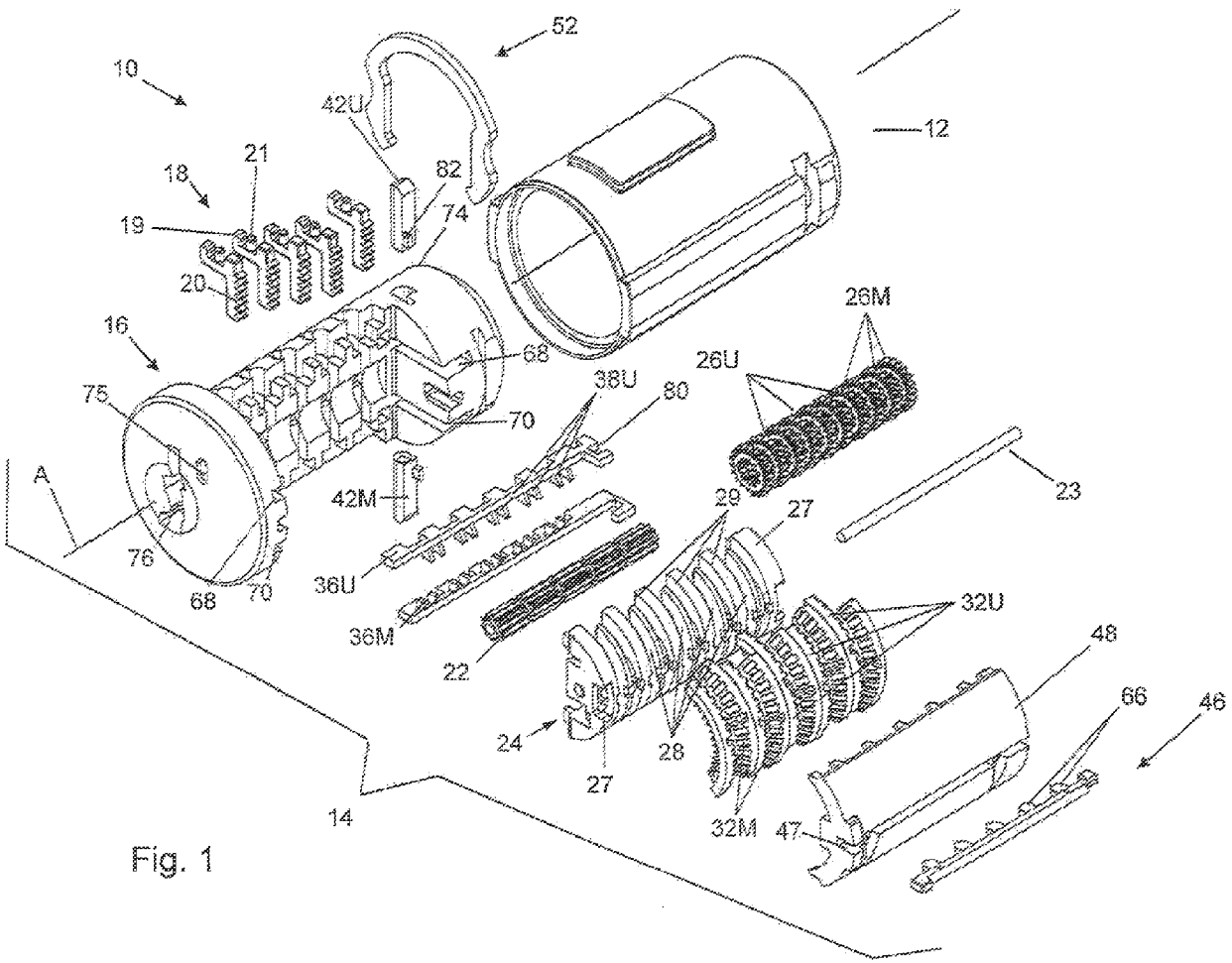
FIG. 1 is an exploded perspective view of an exemplary embodiment of the present invention.
Figure 2:
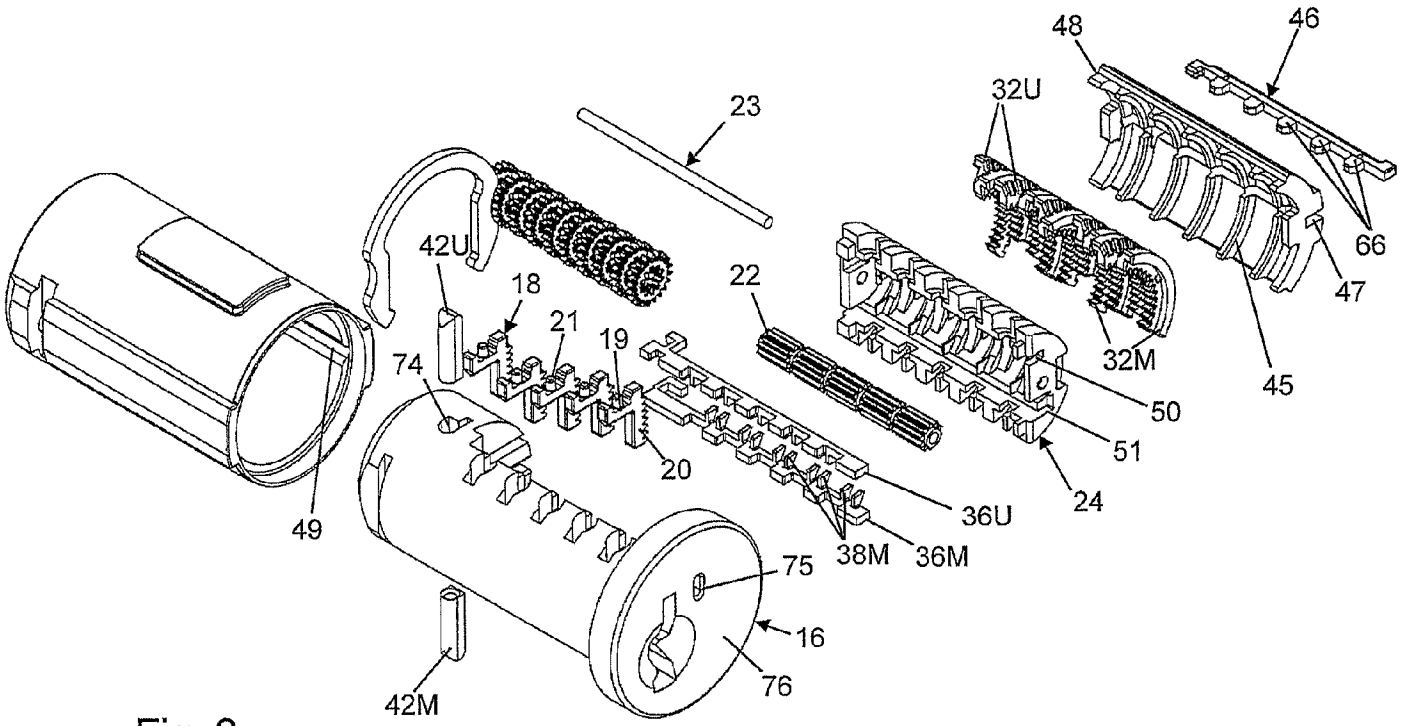
FIG. 2 is a different exploded perspective view of the embodiment of FIG. 1.

One embodiment of a rekeyable master keyable lock cylinder 10 according to the present invention is illustrated in FIGS. 1 and 2. The lock cylinder 10 includes a housing 12 and a plug assembly 14 configured to rotate within the housing 12.

The plug assembly 14 includes a plug body 16, a plurality of key followers or pins 18, a plurality of pin gears 22 mounted on a gear shaft 23, and a gear frame 24. A user gear 26U and a master gear 26M are mounted on each pin gear 22 for rotation therewith. The gears 26U, 26M are free to move longitudinally along their respective pin gear 22 to provide for rekeying functionality, as described below. Although the user and master gears 26U, 26M are illustrated with internal gear teeth to engage the pin gears 22, the gears can have any configuration that permits axial movement along the pin gear shaft 23 while being rotationally locked thereto. A plurality of user racks 32U and master racks 32M are disposed to selectively engage the user gears 26U and master gears 26M, respectively. The plug assembly 14 further includes user and master encoders 36U, 36M, user and master encoder latches 42U, 42M, a locking bar 46 and a locking bar frame 48. A plug clip 52 is configured to engage the cylinder housing 12 and the plug body 16 in a known manner to retain the plug assembly 14 in the housing 12.

The racks 32U, 32M are disposed between the gear frame 24 and the locking bar frame 48. The gear frame 24 includes pair of end plates 27, a plurality of dividers 28, and a plurality of support plates 29 disposed between the end plates 27. Each end plate 27 includes an aperture for receiving the gear shaft 23 and cooperates with the support plates 29 to define a cylindrical channel for receiving the pin gears 22 mounted on the gear shaft 23. The dividers 28 are operatively disposed to separate each user rack 32U from its associated master rack 32M. The support plates 29 are disposed to isolate the user and master rack 32U, 32M at each key follower position from the user and master rack 32U, 32M at adjacent key follower positions. Thus, each set of user and master racks 32U, 32M are associated with a corresponding key follower position. The support plates 29 also support the racks 32U, 32M by providing a curved support surface upon which the racks 32U, 32M ride. The end plates 27 and support plates 29 also cooperate to define upper and lower channels 50, 51 (FIG. 2) for receiving the user and master encoders 36U, 36M, respectively.

The locking bar frame 48 includes an arcuate body with an outer surface that forms a portion of the shear interface between the plug assembly 14 and the housing 12 and defines a locking bar channel 47. The inner surface includes a plurality of ridges 45 depending radially inwardly therefrom. The ridges 45 and inner surface cooperate with the dividers 28 and the support plates 29 to support and maintain the user and master racks 32U, 32M in engagement with the user and master gears 26U, 26M while permitting the user and master racks 32U, 32M to follow an arcuate path about the longitudinal axis A.

The locking bar 46 is disposed in a locking bar recess 49 formed in the housing 12. When the lock is in a locked condition, the locking bar 46 is aligned with the locking bar channel 47. When a valid user key or valid master key is inserted into the lock and rotated, the locking bar 46 cams out of the locking bar recess 49 and into the locking bar channel 47, thereby allowing the plug assembly 14 to rotate in the housing 12.

Figure 3:
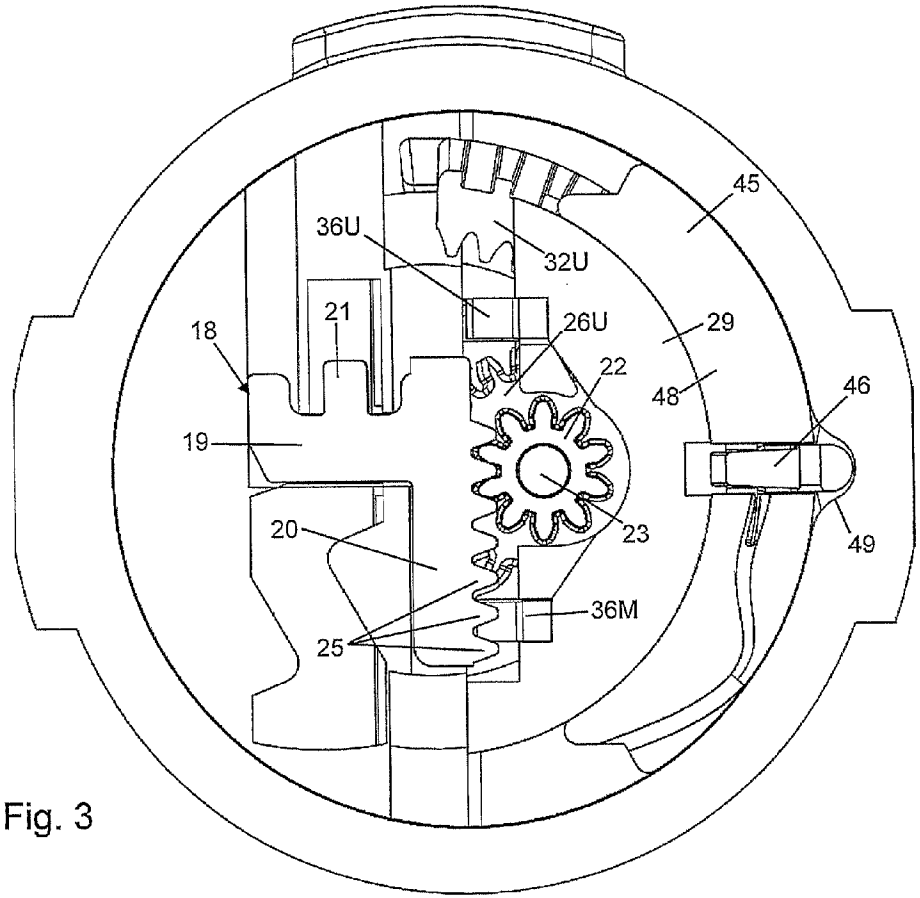
FIG. 3 illustrates the engagement of a key follower with a pin gear.

As illustrated in FIGS. 1-3, each key follower 18 includes a key follower portion 19 and a drive gear portion 20. The key follower portion 19 straddles the keyway formed in the plug assembly to allow the key followers 18 to move up and down with the bitting of the key. A finger 21 formed on the key follower portion 19 engages a spring (not shown) for biasing the key follower 18 toward the key. The drive gear portion 20 includes a plurality of gear teeth 25 and is positioned in the plug body 16 so the gear teeth 25 engage the pin gear 22, as illustrated in FIG. 3.

Figure 4:
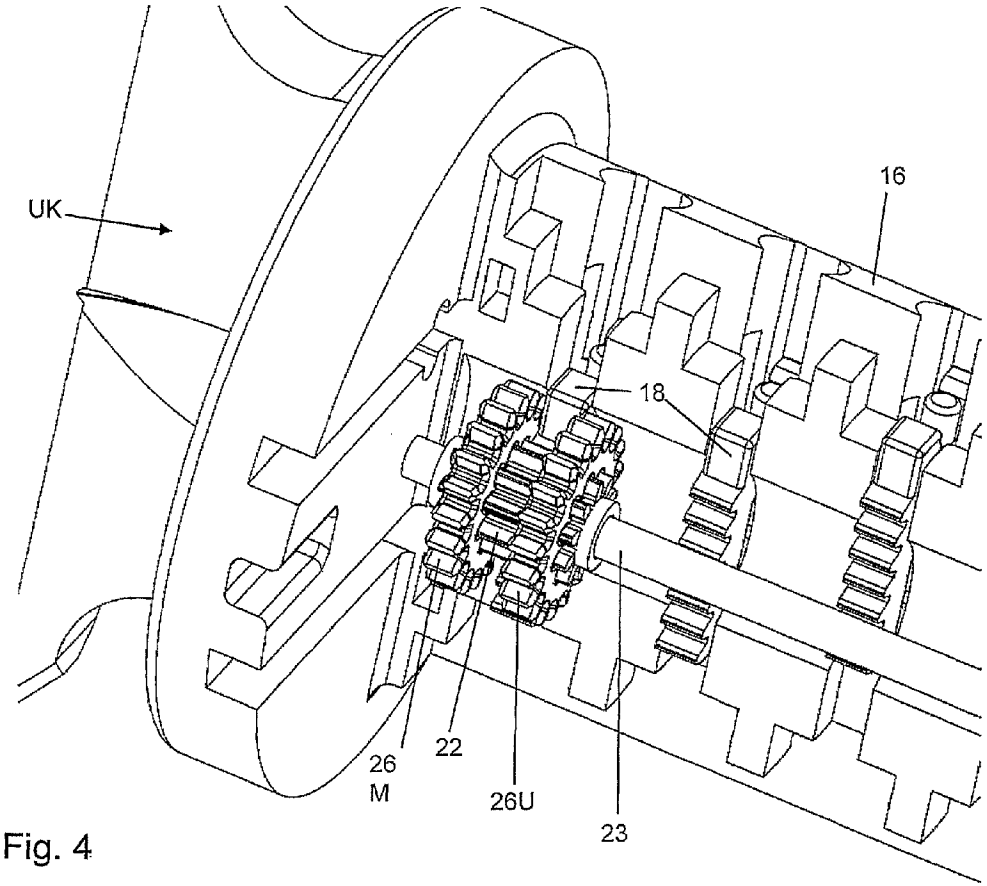
FIG. 4 illustrates a pin, a master gear, a pin gear, and a user gear, the pin engaging the pin gear.
Figure 5:
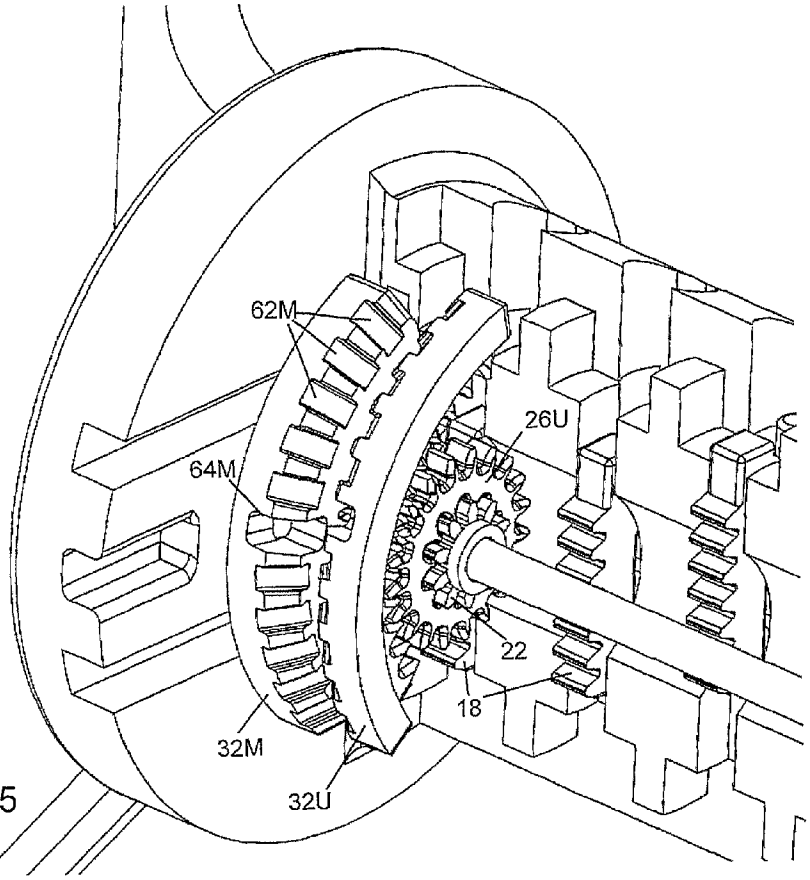
FIG. 5 illustrates a master rack in position to engage a master gear and a user rack engaged with a user gear.
Figure 6:
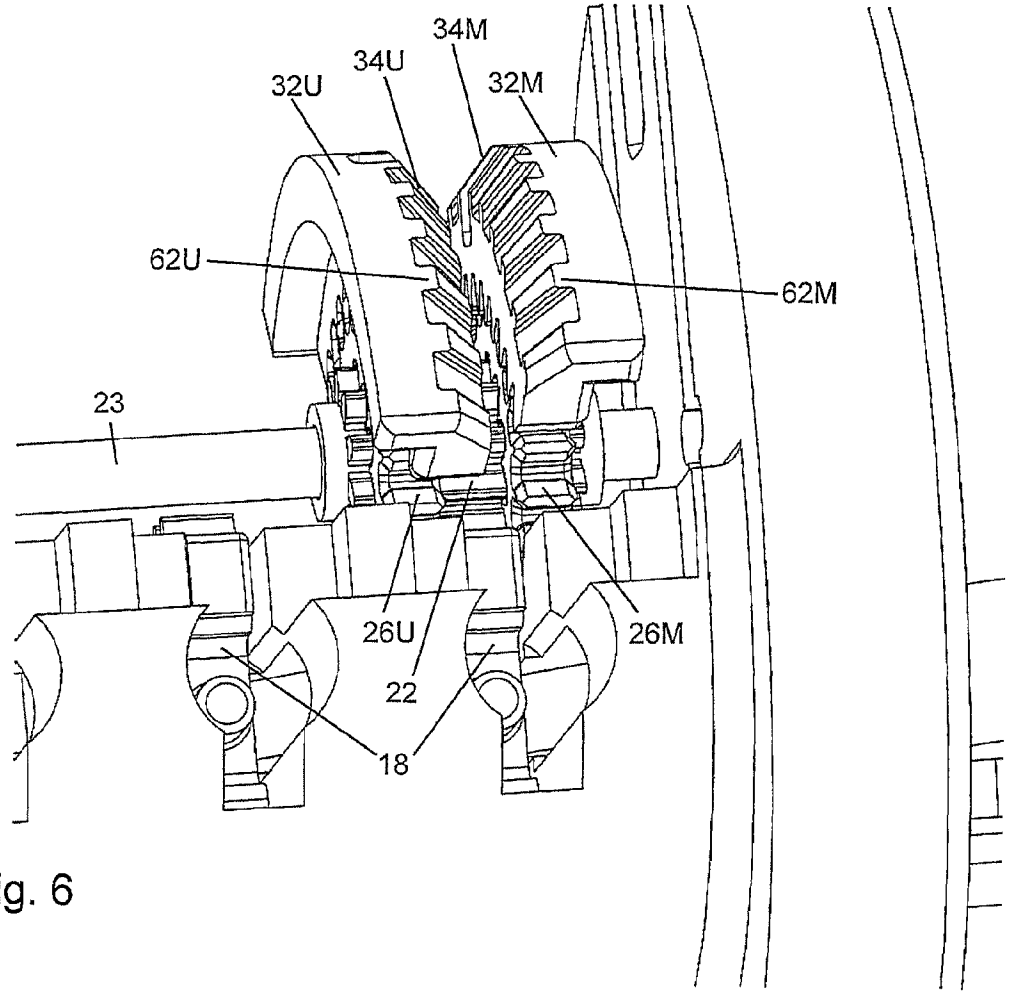
FIG. 6 illustrates the relationship between the pin, the user and master gears, and the user and master racks.

Insertion of a key causes the key followers 18 to move up and down with the bitting. As the key followers 18 move, they cause the pin gears 22 to rotate about the gear shaft 23. With the associated user gear 26U and master gear 26M mounted on each pin gear 22, as shown in FIG. 4, movement of the key follower 18 rotates both the user gear 26U and the master gear 26M. The user gear 26U and master gear 26M, in turn, engage the user rack 32U and master rack 32M, respectively, as shown in FIGS. 5 and 6, causing them to move arcuately about the longitudinal axis A. Thus, the racks 32U, 32M are coupled to the key followers 18. The bitting of the key determines the final position of the racks 32U, 32M.

Figure 7:
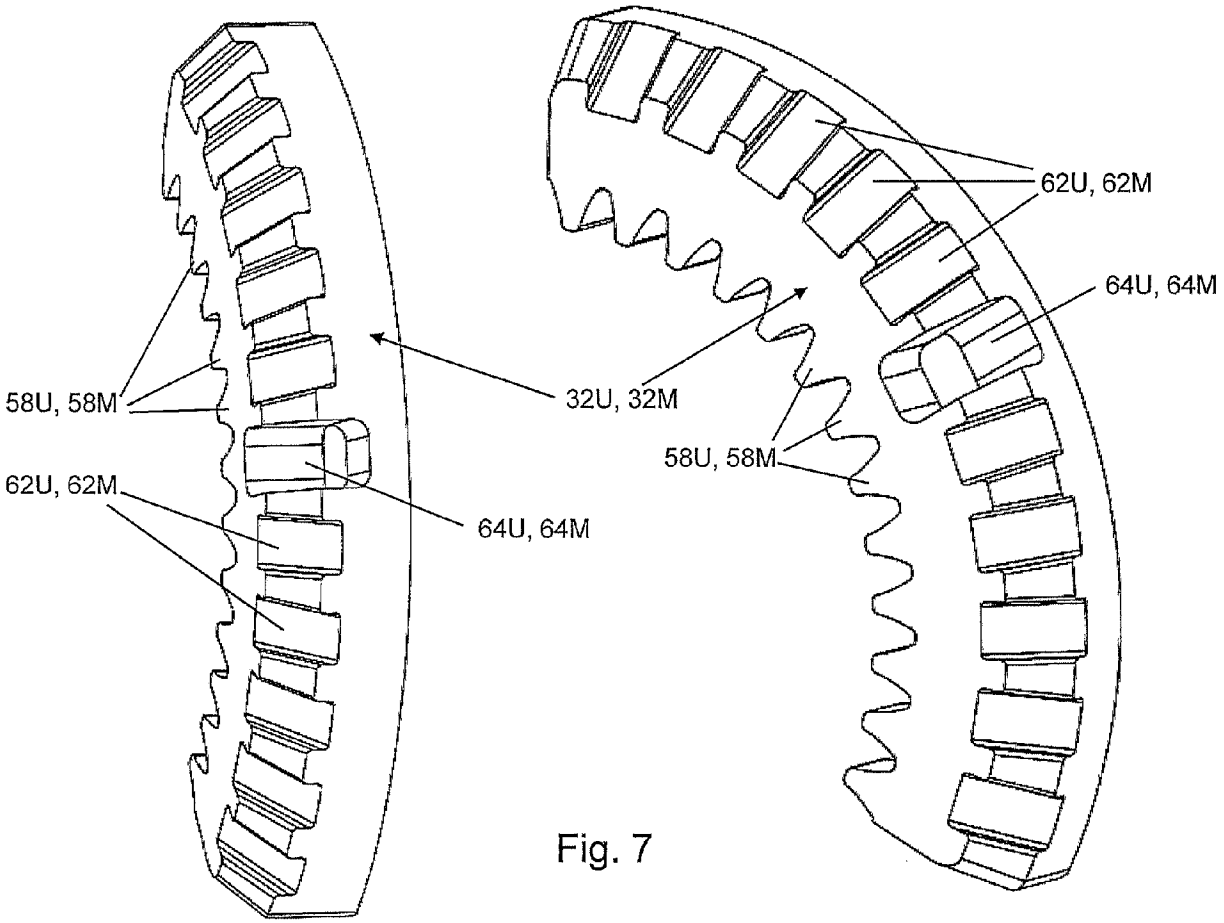
FIG. 7 illustrates racks for use with the embodiment of FIG. 1.

FIG. 7 illustrates racks for use in the embodiment of FIG. 1. The racks are interchangeable and can be used as either user racks 32U or master racks 32M, depending on their orientation when installed in the plug assembly 14. The racks 32U, 32M are approximately quarter-circular with a plurality of radially inwardly facing gear teeth 58U, 58M. The gear teeth 58U, 58M are configured to engage the user gears 26U and master gears 26M, respectively. Each rack 32U, 32M also includes a beveled surface 34U, 34M (FIG. 6) formed with a plurality of beveled gear teeth 62U, 62M and a locking bar receiving slot 64U, 64M, respectively.

Normal Operation

Figure 8:
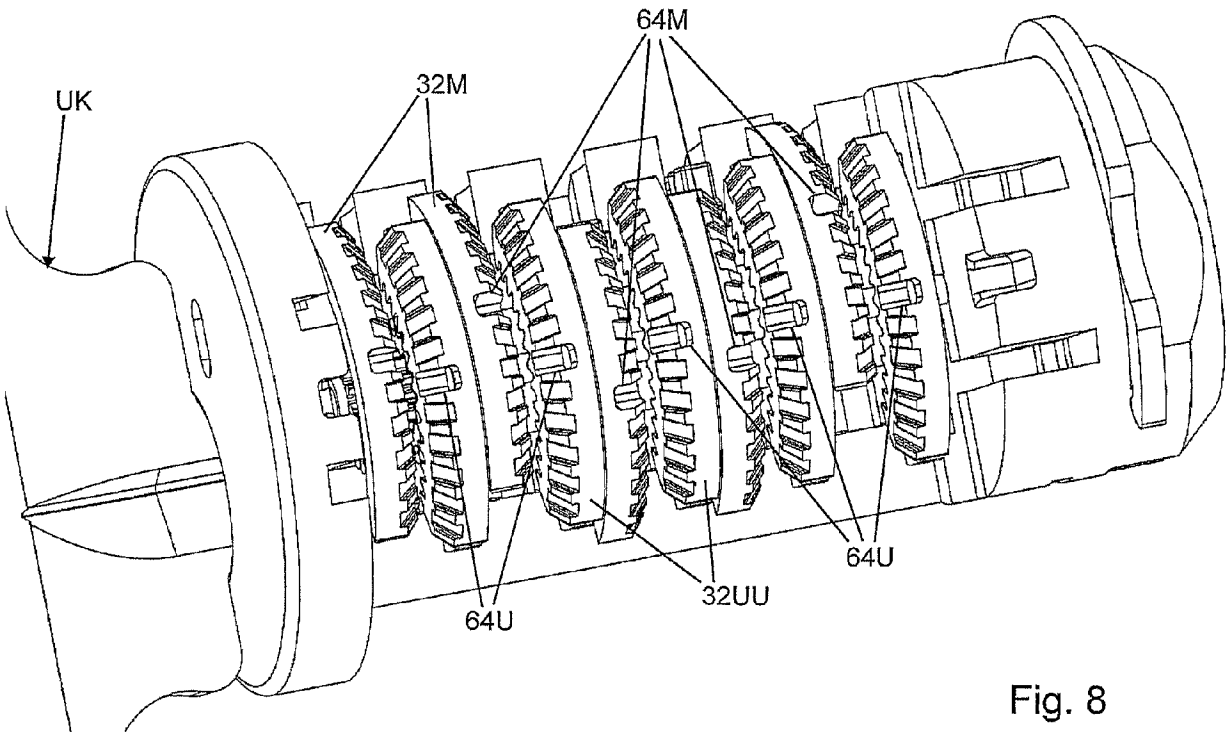
FIG. 8 illustrates the alignment of the user racks with a valid user key inserted into the lock cylinder.
Figure 9:
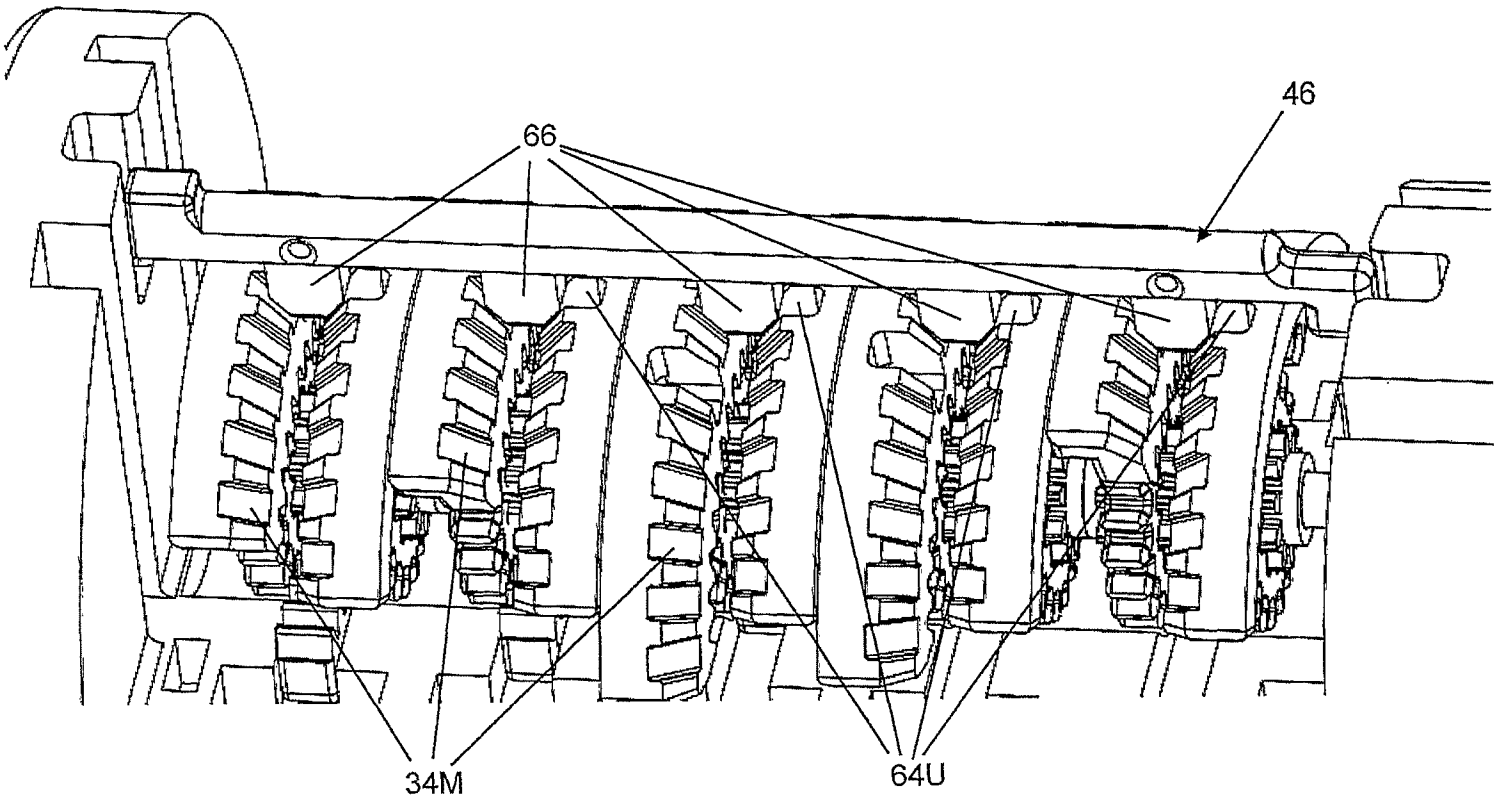
FIG. 9 illustrates a locking bar in position to engage the aligned racks.
Figure 10:
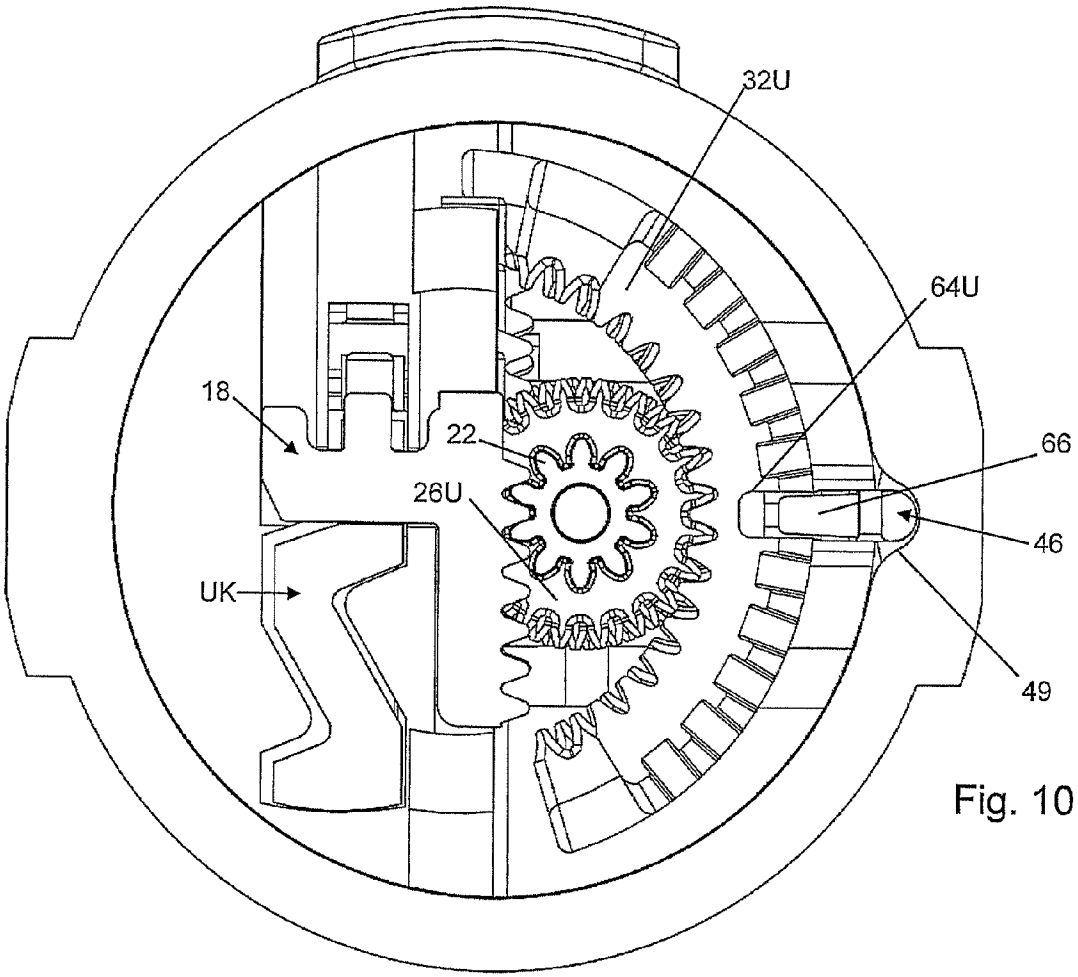
FIG. 10 illustrates the lock in a home, or locked position, with a valid user key inserted in the plug assembly.
Figure 11:
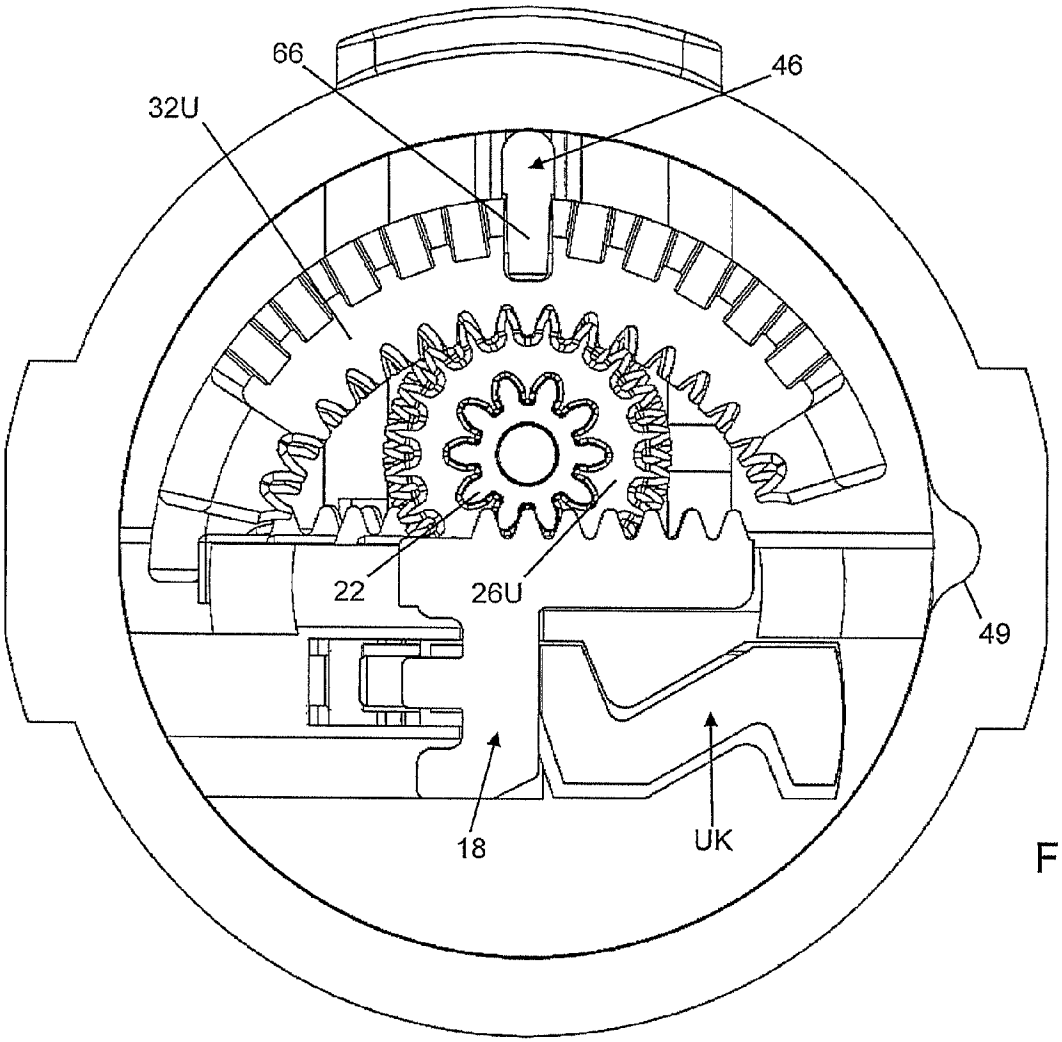
FIG. 11 illustrates the lock cylinder of FIG. 10 with the lock cylinder rotated to the unlocked position.

When a valid user key UK is inserted into the lock cylinder, the racks 32U, 32M move to their final position, based on the key bitting. For a valid user key UK, the user racks 32U are aligned to a common axis, with the slots 64U aligned as illustrated in FIG. 8. When aligned, the slots 64U are configured and aligned to engage chamfered tabs 66 (FIGS. 1 and 2) formed on the locking bar 46. As illustrated in FIG. 9, the chamfered tabs 66 are in position to enter the slots 64U of the user racks 32U. As the lock plug assembly 14 rotates in the cylinder housing 12, the locking bar 46 cams out of the locking bar recess 49 and into the locking bar channel 47, forcing the chamfered tabs to slide along the beveled surface 34M of the master racks 32M and into the slots 64U, as illustrated in FIGS. 10 and 11. Similar functionality applies if a valid master key is inserted, whereby the slots 64M of the master racks 32M are aligned along a common axis. In that case, the chamfered tabs 66 slide along the beveled surfaces 34U of the user racks 32U and into the slots 64M.

As illustrated in FIG. 10, a valid user key UK has been inserted, aligning the slots 64U in the user racks 32U. Before the plug assembly 14 is rotated in the housing 12, the locking bar 46 is biased radially outwardly and disposed in the locking bar recess 49, blocking the shear line. As the user key UK is rotated from the home position shown in FIG. 10 to the unlocked position illustrated in FIG. 11, the locking bar 46 cams out of the locking bar recess 49, forcing the chamfered tabs 66 to enter the slots 64U, thereby unblocking the shear interface. When returned to the home position, the locking bar 46 is pushed out of the slots 64U and into the locking bar recess 49 by biasing springs (not shown). As the key UK is removed from the plug assembly 14, biasing springs (not shown) push the key followers 18 downwardly, thereby moving the racks 32U, 32M to a position wherein the slots 64 U are no longer aligned along a common axis.

If a non-valid key is inserted, the racks 32U will be moved to a position wherein at least one of the slots 64U will not align along a common axis. In that case, attempting to rotate the plug assembly 14 in the housing 12 will force the chamfered tab 66 to engage the opposing beveled surfaces 62U, 62M of the misaligned rack 32U, thereby preventing the locking bar 46 from camming out of the locking bar recess 49 and preventing the plug assembly 14 from rotating in the housing 12.

Rekeying Operation

Rekeying the lock cylinder 10 to accept a new user key is accomplished by decoupling the user gears 26U from the user racks 32U while retaining the user racks 32U in alignment along a common axis, rotating the user gears 26U to a new position by inserting a new user key, and recoupling the user gears 26U with the user racks 32U. Rekeying the master key is accomplished in a similar manner, but decouples and recouples the master gears 26M and master racks 32M from the key followers 18.

Rekeying the embodiment illustrated in FIGS. 1 and 2 utilizes the encoders 36U, 36M and the encoder latches 42U, 42M to decouple the gears 26U, 26M from the racks 32U, 32M and retain the gears 26U, 26M in the decoupled position while the original user key or master key is being replaced by a new key. The user encoder 36U and master encoder are disposed in channels 68 and 70, respectively, formed in the plug body 16. The encoder latches 42U, 42M are disposed in channel 74 which extends through the plug body 16. A biasing spring (not shown) is disposed between the latches 42U, 42M to bias the latches 42U, 42M radially outwardly.

Figure 12:
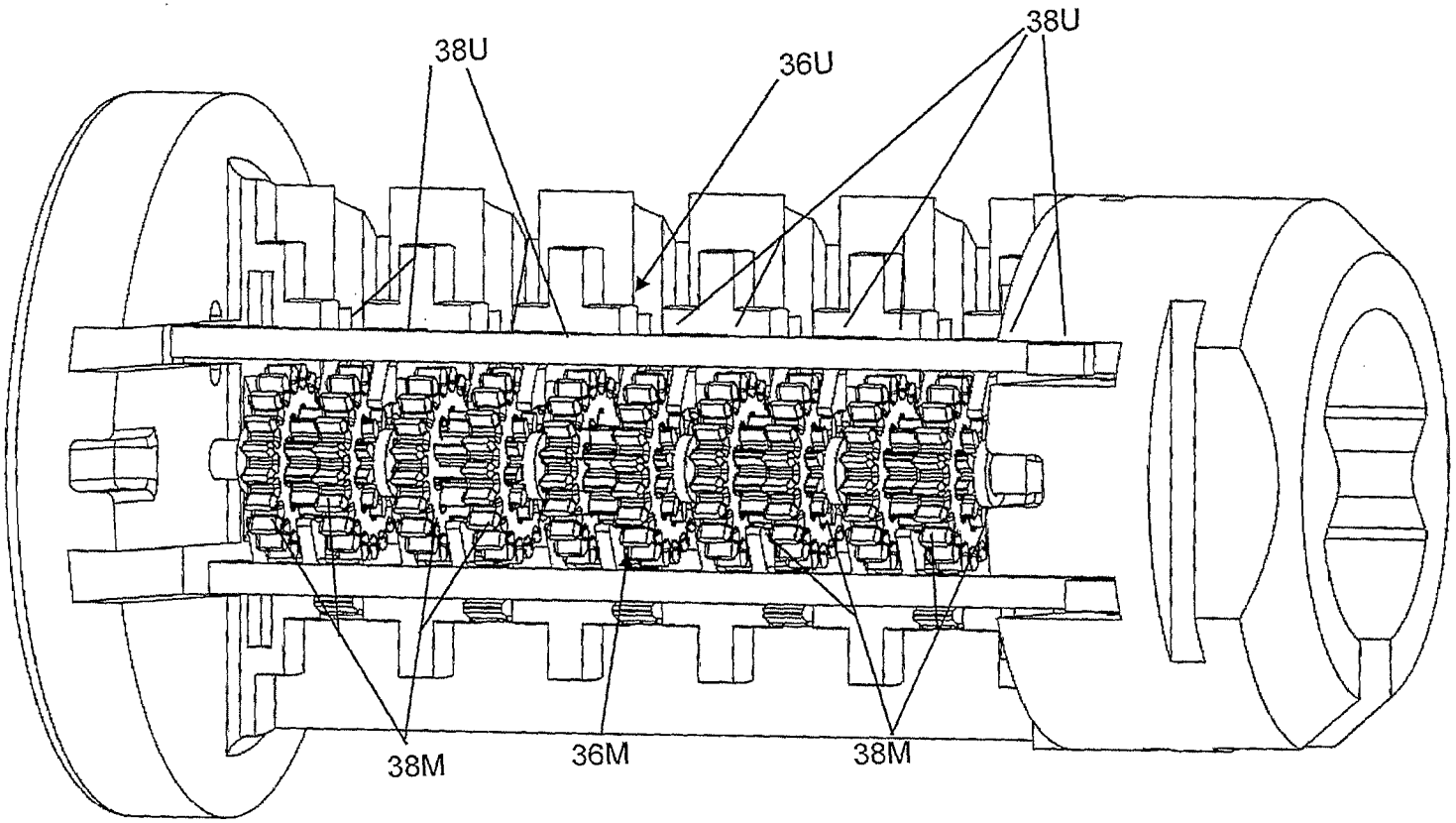
FIG. 12 illustrates a user encoder and a master encoder disposed to engage user and master gears, respectively.

Each encoder 36U, 36M includes multiple pairs of tabs 38U, 38M arranged along the length of the encoder 36U, 36M. Each pair of tabs 38U, 38M is disposed to engage a user gear 26U or a master gear 26M, respectively, as illustrated in FIG. 12.

Figure 13:
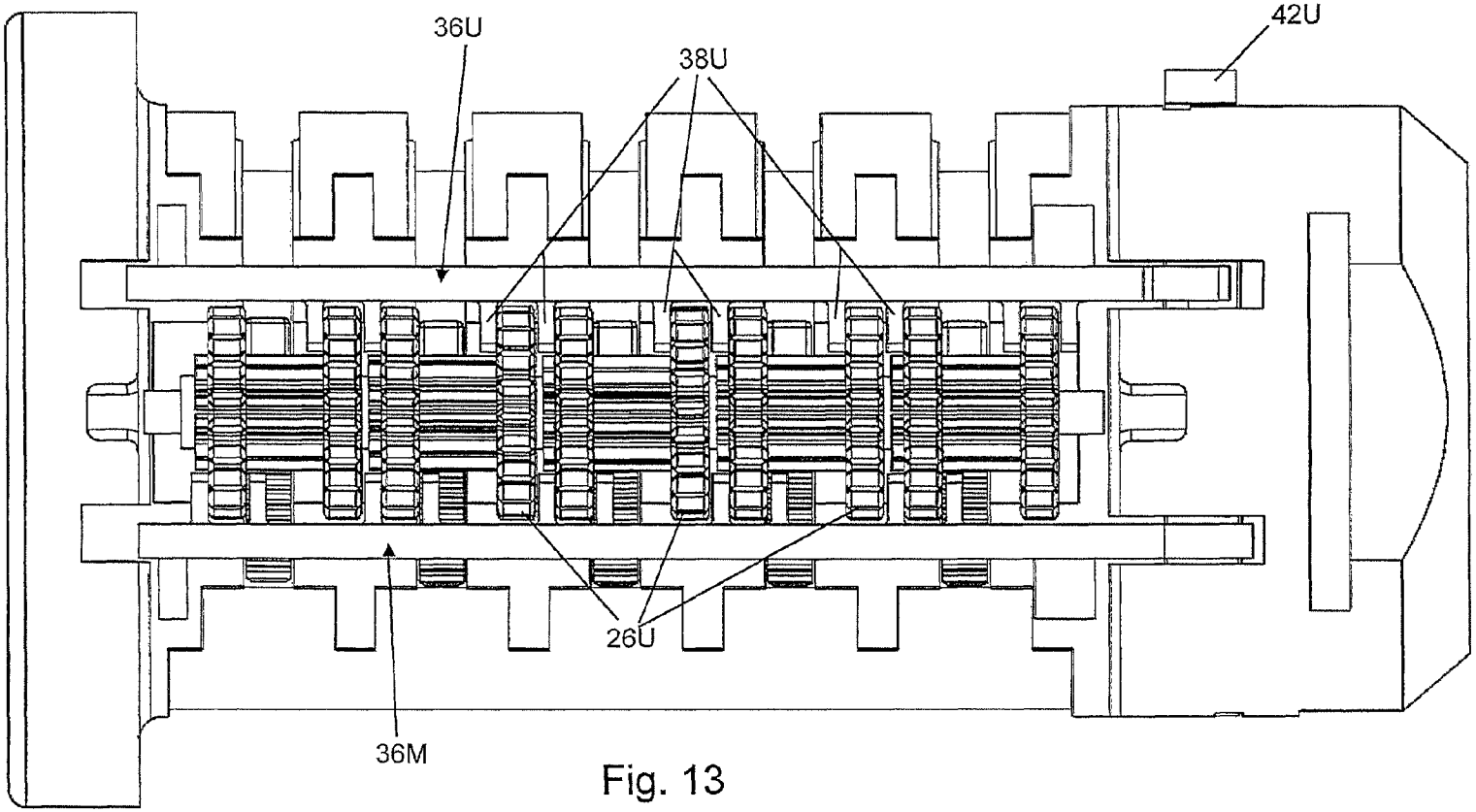
FIG. 13 illustrates the user gears moved to a position where they would be disengaged from the user racks.
Figure 14:
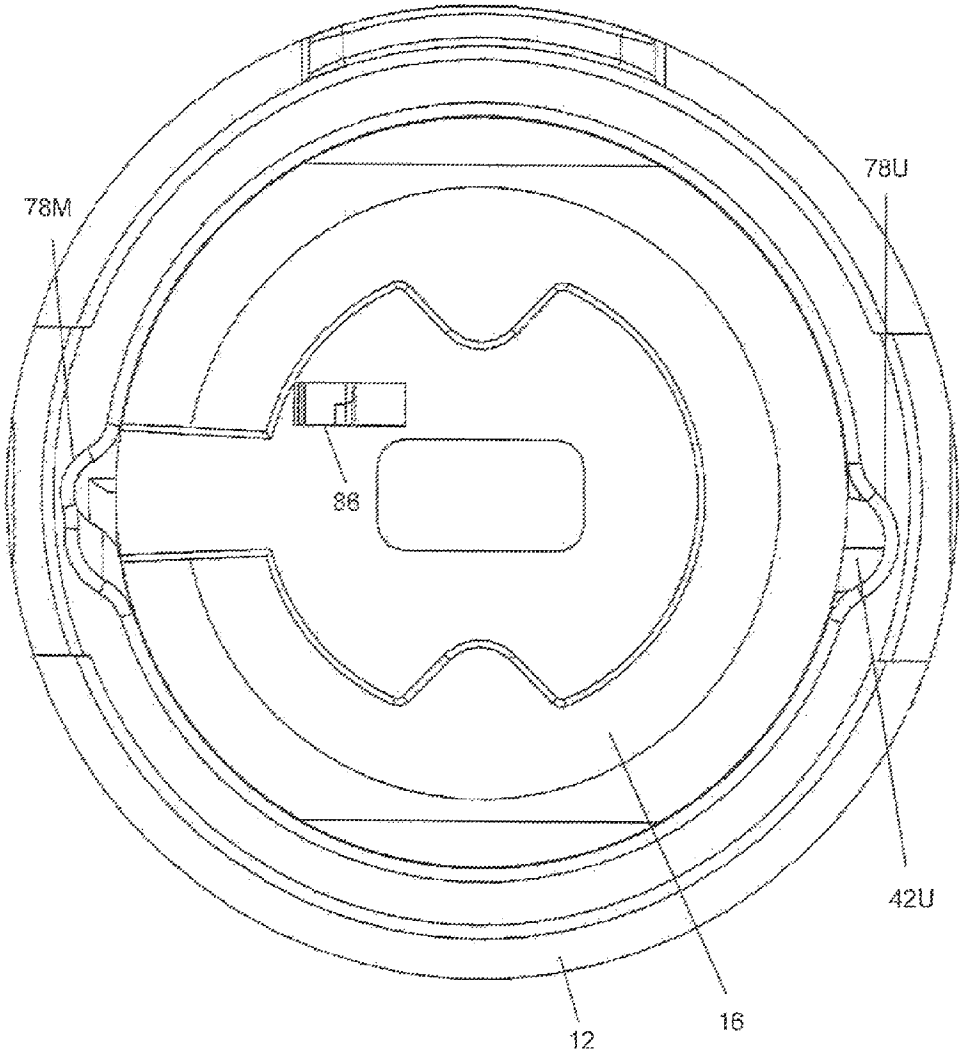
FIG. 14 illustrates a recess in the housing for receiving an encoder latch.

In the embodiment of the invention illustrated in FIGS. 1 and 2, a valid user key UK is inserted, thereby aligning the user racks 32U as discussed above. The user rotates the plug assembly 14 about 90° counterclockwise to a rekeying position illustrated in FIG. 11. The user encoder 36U is aligned with an aperture 75 in the face 76 of the plug assembly 16. The user then inserts a tool (not shown) through the aperture 75 and pushes the user encoder 36U against a biasing spring (not shown) away from the face 76 of the plug assembly 16 from a first position to a second position. Pushing the user encoder 36U to the second position causes the pairs of tabs 38U to axially displace the user gears 26U along the pin gear 22, as illustrated in FIG. 13. Since the user racks 32U are fixed axially by the combination of ridges 45, dividers 28 and support plates 29, axial displacement of the user gears 26U disengages the user gears 26U from the user racks 32U. At the same time, a notch 80 in the user encoder 36U aligns with the channel 74 to permit the user encoder latch 42U to extend radially outwardly to engage a recess 78U in the housing 12, as illustrated in FIG. 14. A dog 82 on the user encoder latch 42U enters the notch 80 to prevent the user encoder 36U from returning to the first position.

At this point, only the user racks 32U are prevented from moving. The user gears 26U are disengaged from the user racks 32U, allowing the user gears 26U to rotate with the pin gear 22, while the user racks 32U are retained in position by the tabs 66 on the locking bar 46. At the same time, because the tabs 66 are disposed in the slots 64U of the user racks 32U, they are disengaged from the master racks 32M and the master racks 32M are free to move as their respective master gears 26M rotate with the pin gear 22. Thus, the current user key UK can be removed and replaced by a new user key.

As the new user key is inserted, the key followers 18 move up and down with the key bitting, causing the pin gears 22 to rotate to new positions. With the new user key fully inserted, the plug assembly 14 is rotated 90° clockwise to the original home position. At the same time, rotating the plug assembly 14 causes the user encoder latch 42U to cam out of the recess 78U in the housing 12, thereby moving the dog 82 out of the notch 80 in the user encoder 36U and allowing the user encoder 36U to move from the second position back to the first position. Movement of the user encoder 36U to the first position causes the tabs 38U to move the user gears 26U axially along the pin gear 22 and into engagement with the user racks 32U. With the user gears 26U engaged with the user racks 32U, the lock is rekeyed to the new user key and the original user key no longer operates the lock.

Rekeying the master key is functionally the same as rekeying the user key. That is, the master racks 32M are maintained in position by the tabs 66 on the locking bar 46 while the master gears 26M are displaced axially along the pin gears 22 so as to disengage from the master racks 32M. Pushing the master encoder 36M axially displaces the master gears 26M and releases the master encoder latch 42M to enter a recess 78M in the housing 12 to retain the master encoder 36M in position. However, in the embodiment illustrated in the drawings, the user would rotate the plug assembly 14 approximately 90° counterclockwise to the rekeying position (when viewed from the front) and the tool would be inserted into an aperture 86 located in the back of the plug assembly (FIG. 14), with the tool pushing the master encoder 36M toward the face 76 to disengage the master gears 26M from the master racks 32M. In all other respects, the master key rekeying process is the same.

It will be appreciated by those of ordinary skill in the art that it would be possible to add a second aperture to the face of the plug assembly or to relocate one or both encoders to allow the both the user key and master key to be rekeyed from the front of the plug assembly.

While the present invention has been described with particular reference to a preferred embodiment of a lockset mechanism, one skilled in the art will recognize that the present invention may be readily adapted to embodiments other than those described with reference to the preferred embodiments. Furthermore, those skilled in the art will readily recognize from the foregoing discussion and accompanying drawings and claims, that changes, modifications and variations can be made in the present invention without departing from the spirit and scope thereof as defined in the following claims.

The invention claimed is:

1. A method of rekeying a master keyable lock comprising the steps of:

providing a plug assembly rotatable within a housing;

providing a plurality of key followers disposed in the plug assembly;

providing a plurality of user racks having slots and a plurality of master racks having slots disposed in the plug assembly, wherein each user rack of the plurality of user racks is associated with a master rack of the plurality of master racks, and wherein each of the plurality of user racks and plurality of master racks is coupled to an associated key follower and movable in response to movement of the associated key follower;

inserting a first key with a first key bitting;

aligning the slots of the plurality of user racks or the slots of the plurality of master racks to a common axis;

decoupling either the plurality of user racks or the plurality of master racks from the plurality of key followers, wherein the user racks and the master racks are configured to operate independently of each other such that if the user racks are decoupled the master racks remain coupled, and if the master racks are decoupled the user racks remain coupled;

removing the first key and inserting a second key with a second key bitting; and recoupling the plurality of user racks or the plurality of master racks to the plurality of key followers.

2. The method of claim 1 wherein the first key is a valid user key and the step of aligning further includes the step of aligning slots of the plurality of user racks to a common axis, based on the user key biting.

3. The method of claim 1 wherein the first key is a valid master key and the step of aligning further includes the step of aligning slots of the plurality of master racks to a common axis, based on the master key biting.

4. A method of rekeying a master keyable lock cylinder having a longitudinal axis comprising the steps of:

providing a plurality of gears;

providing a plurality of racks having slots coupled to the plurality of gears;

inserting a first key with a first key bitting;

maintaining slots of the plurality of racks aligned along a common axis;

displacing the gears parallel to the longitudinal axis to decouple the plurality of gears from the plurality of racks;

replacing the first key with a second key with second key bitting; and displacing the plurality of gears in a direction parallel to the longitudinal axis to recouple the plurality of gears with the plurality of racks.

5. The method of claim 4 further including the steps of providing an encoder configured to engage the plurality of gears and moving the encoder from a first position to a second position to displace the plurality of gears.

6. The method of claim 5 further including the steps of providing an encoder latch configured to engage the encoder and moving the encoder latch in a direction transverse to the longitudinal axis to retain the encoder in the second position.

7. The method of claim 4 further including the steps of providing an encoder latch and positioning the encoder latch to maintain the plurality of gears decoupled from the plurality of racks.

8. The method of claim 4 further including the step of providing a locking bar configured to maintain the plurality of racks aligned along the common axis.

9. A master keyable rekeyable lock having a longitudinal axis, the lock comprising:

a housing;

a plug assembly disposed for rotation within the housing;

a plurality of key followers disposed in the plug assembly;

a first plurality of racks disposed in the plug assembly and coupled to the plurality of key followers;

a second plurality of racks disposed in the plug assembly and coupled to the plurality of key followers;

a locking bar disposed in the housing for selectively engaging the first plurality of racks and the second plurality of racks; and a first plurality of gears disposed between the first plurality of racks and the plurality of key followers and a second plurality of gears disposed between the second plurality of racks and the plurality of key followers.

10. The lock of claim 9, wherein the first plurality of gears is configured for axial displacement from the first plurality of racks to decouple the first plurality of gears from the first plurality of racks to permit replacing a first user key with a second user key.

11. The lock of claim 10 wherein the second plurality of gears is configured for axial displacement from the second plurality of racks to decouple the second plurality of gears from the second plurality of racks to permit replacing a first master key with a second master key.

12. The lock of claim 9 further including an encoder configured to decouple the first plurality of racks from the plurality of key followers.

13. The lock of claim 12 further including an encoder latch configured to engage the encoder to maintain the first plurality of racks decoupled from the plurality of key followers.

14. The lock of claim 9 further including a first encoder configured to decouple the first plurality of racks from the plurality of key followers and a second encoder configured to decouple the second plurality of racks from the plurality of key followers.

15. The lock of claim 9 further including a plurality of tabs formed on the locking bar and a tab receiving slot formed in each rack of the first and second pluralities of racks, wherein the tabs are configured to be received in the slots of one of the first plurality of racks and the second plurality of racks to selectively engage the first plurality of racks and the second plurality of racks.

16. A master keyable rekeyable lock comprising:

a plurality of key followers;

a first plurality of gears coupled to the key followers;

a first plurality of racks coupled to the plurality of gears;

a first encoder including means for moving the first plurality of gears to decouple the first plurality of gears from the first plurality of racks; and a first encoder latch coupled to the first encoder to maintain the first plurality of gears decoupled from the first plurality of racks.

17. The lock of claim 16 further including a locking bar configured to engage the first plurality of racks to maintain the first plurality of racks aligned along a common axis.

18. The lock of claim 16 further including a second plurality of gears coupled to the plurality of key followers and a second plurality of racks coupled to the second plurality of gears.

19. The lock of claim 18 further including a second encoder including means for moving the second plurality of gears to decouple the second plurality of gears from the second plurality of racks and a second encoder latch coupled to the second encoder to maintain the second plurality of gears decoupled from the second plurality of racks.

20. A master keyable rekeyable lock having a longitudinal axis, the lock comprising:

a housing;

a plug assembly disposed for rotation within the housing;

a plurality of key followers disposed in the plug assembly;

a first plurality of racks disposed in the plug assembly and coupled to the plurality of key followers, a second plurality of racks disposed in the plug assembly and coupled to the plurality of key followers, wherein each rack of the second plurality of racks corresponds with a rack of the first plurality of racks;

a locking bar configured to selectively engage either all of the first plurality of racks or all of the second plurality of racks; and wherein the first plurality of racks or the second plurality of racks move along an arcuate path about the longitudinal axis u son movement of the plurality of key followers coupled to the first plurality of racks or second plurality of racks.

21. The lock of claim 20 wherein the locking bar is further configured to maintain the one of the first plurality of racks or the second plurality of racks aligned along a common axis.

* * * * *